United States Patent [19]

Stauffer

[11] 4,188,936

[45] Feb. 19, 1980

[54] METHOD FOR INCREASING THE CUTTING PERFORMANCE OF RECIPROCATING SLURRY SAWS AND A RECIPROCATING SLURRY SAW FOR CARRYING OUT THIS METHOD

[75] Inventor: Alfred Stauffer, Steffisburg, Switzerland

[73] Assignee: Maschinenfabrik Meyer & Burger AG, Steffisburg-Station, Switzerland

[21] Appl. No.: 865,031

[22] Filed: Dec. 27, 1977

[30] Foreign Application Priority Data

Dec. 27, 1976 [CH] Switzerland ..... 16334/76

[51] Int. Cl.[2] ..... B28D 1/02

[52] U.S. Cl. ..... 125/16 R; 51/59 R; 51/283 R

[58] Field of Search ..... 51/59 R, 59 SS, 283 R; 125/12, 16 R

[56] References Cited

U.S. PATENT DOCUMENTS

| | | | |
|---|---|---|---|
| 2,312,014 | 2/1943 | Wallace | 51/59 R |
| 2,813,377 | 11/1957 | Duran | 51/59 SS |
| 2,967,381 | 1/1961 | Brown | 125/12 UX |
| 3,031,804 | 5/1962 | Thatcher | 51/59 SS |
| 3,077,132 | 2/1963 | Whitmore | 83/201 |
| 3,212,376 | 10/1965 | Berenbak et al. | 83/4 |
| 3,326,071 | 6/1967 | Bushman et al. | 83/7 |
| 3,525,324 | 8/1970 | Bonnefoy et al. | 125/16 R |
| 3,674,004 | 7/1972 | Grandia et al. | 125/16 R |
| 4,105,012 | 8/1978 | Hini | 125/16 R |

FOREIGN PATENT DOCUMENTS

| | | | |
|---|---|---|---|
| 2537088 | 2/1977 | Fed. Rep. of Germany | 125/12 |

*Primary Examiner*—Harold D. Whitehead

*Attorney, Agent, or Firm*—Sughrue, Rothwell, Mion, Zinn and Macpeak

[57] ABSTRACT

A method for increasing the cutting performance of reciprocating slurry saws of the type in which cutting blades are held in a clamping frame is accomplished displacing the clamping frame at a frequency above two cycles per second in reciprocating motion and utilizing a shorter stroke than in the known machines. The frequency is high, e.g., between two and 50 or more cycles per second, the stroke is short, e.g., between one and 75 millimeters, and the cutting performance is increased exponentially over known saws. Various mechanical embodiments are disclosed for obtaining the high frequency drive.

9 Claims, 7 Drawing Figures

METHOD FOR INCREASING THE CUTTING PERFORMANCE OF RECIPROCATING SLURRY SAWS AND A RECIPROCATING SLURRY SAW FOR CARRYING OUT THIS METHOD

BACKGROUND OF THE INVENTION

1. Field of the Invention

This invention relates to an improved method for increasing the performance of reciprocating slurry saws and slurry saws for carrying out such improved method.

2. Prior Art

Reciprocating slurry saws are known in the prior art and are in common use commercially for cutting or wafering quartz or semiconducting crystals into small delicate plates that are used in the production of oscillators or semiconducting elements. In such saws, a clamping frame clamps and tensions a plurality of steel blades held parallel to one another and spaced apart. The clamping frame is reciprocated while a slurry of abrasive liquid is poured onto the cutting area. One such known prior art slurry saw is made by the assignee of this application, Maschinenfabrik Meyer & Burger, AG, known as the GS1, and is substantially in accordance with my prior U.S. Pat. No. 3,678,918. Another commercially available slurry saw is manufactured by Varian Associates along the lines of U.S. Pat. No. 3,079,908.

The known reciprocating slurry saws operate with a relatively long stroke of the clamping frame which carries the saw blades—i.e., a stroke of 80–200 millimeters—and a relatively low number of strokes per unit of time—i.e., low frequency. The highest known drive frequencies lie in the range of two cycles per second.

While the known slurry saws are commercially successful, if the average cutting speed could be increased, the cost of production of the units which are wafered could be reduced.

SUMMARY OF THE INVENTION

It has been found that by increasing the cutting speed, the cutting performance is surprisingly increased a disproportionate and additional amount. This is accomplished by reciprocating the clamping frame at a frequency above the highest known drive frequency—e.g., from three cycles per second up to 50 cycles per second and higher. As a surprising result the cutting performances are many times the cutting performance of the known reciprocating saws. Not only is the drive frequency increased but the stroke of the clamping frame and cutting blades is shortened. This also allows the length of the cutting blades to be shortened, thereby allowing the contact pressure on the workpiece to be increased without danger, thus making possible an additional increase in cutting performance. Furthermore, with short strokes and high frequency of the clamping frame and blades, an especially simply drive system can be employed, for example, electromagnetic drives which operate at 50–100 cycles per second and can be fed directly from a power line.

Several embodiments of drives for reciprocating saw to increase the frequency cutting speed include a crank drive with mass compensation, hydro-impulse drive, linear motor drive, and a vibration exciter drive.

DESCRIPTION OF THE PREFERRED EMBODIMENTS

Figure 7:
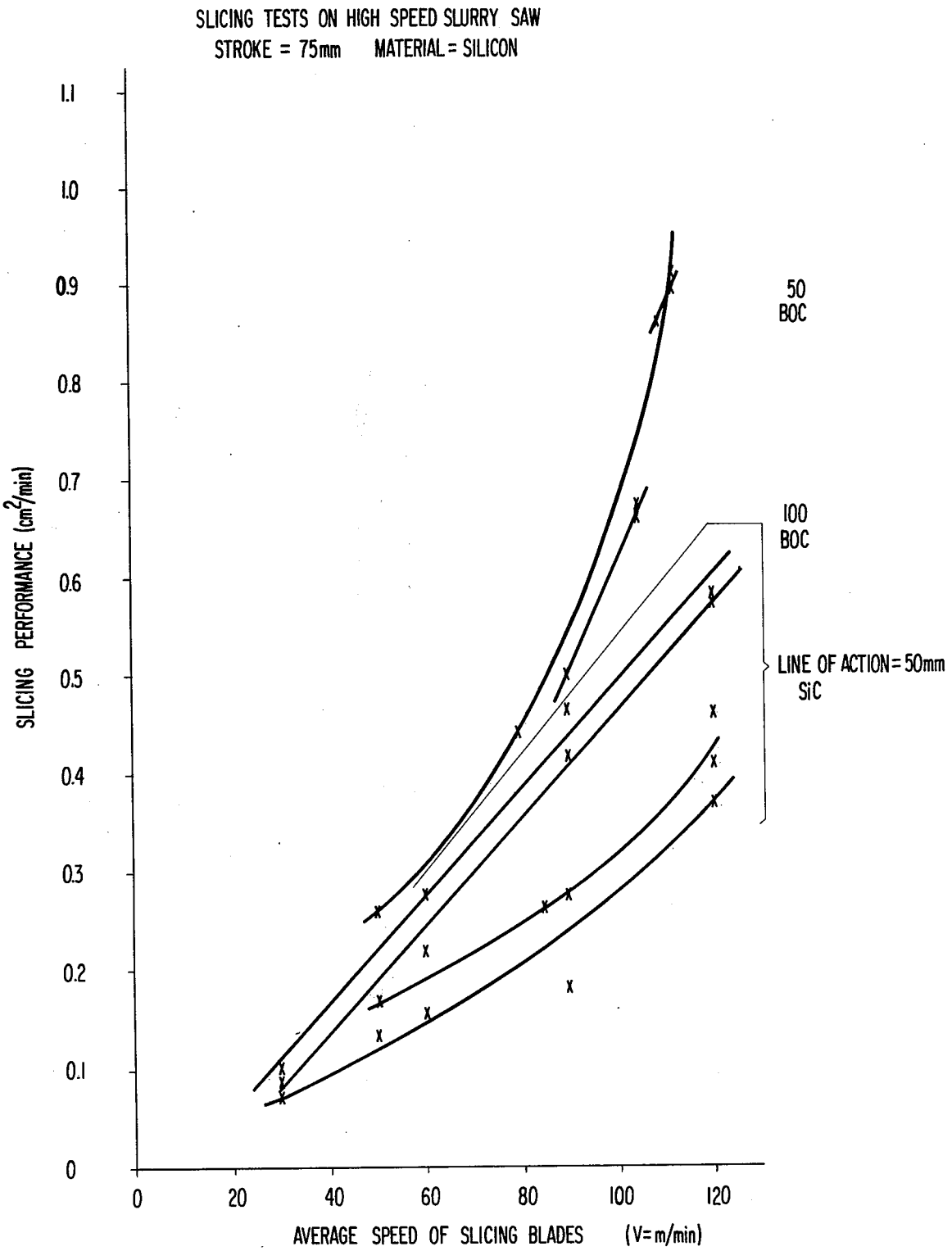
FIG. 7 is a graph plotting the slicing performance against the average speed of the slicing blades.

The graph of FIG. 7 is a plot of the average speed of the slicing blades in meters per minute of a reciprocating slurry saw of the type discussed above plotted against the slicing performance in square centimeters per minute. The material being sliced is silicon, and the different abrasives are indicated, including boron carbide and silicon carbide.

A typical commercial slurry saw, the Meyer & Burger GS1, achieves a maximum cutting speed of 30 meters per minute. As can be seen on the graph, this results in about 0.1 square centimeter per minute or less slicing performance. By means of this invention, cutting speed of 120 meters per minute can be achieved. Note that with the fourfold increase in cutting speed, there is a surprisingly favorably disproportionate increase in the slicing performance. It was believed that an increase in average cutting speed would not obtain even a proportionate increase in results because of the difficulty in getting the cutting slurry into contact with the blades and the work-piece, particularly into the saw kerfs. This graph is the actual plot of test results, and some variation can be accounted for by the fact that the quality in concentration of the abrasive slurry cannot be exactly controlled.

Referring now to the various drive possibilities, it is first noted that the reciprocating saw components, except for the drive can conveniently be in the form disclosed in my prior U.S. Pat. No. 3,678,918, and hence will not be described in detail.

Figure 1:
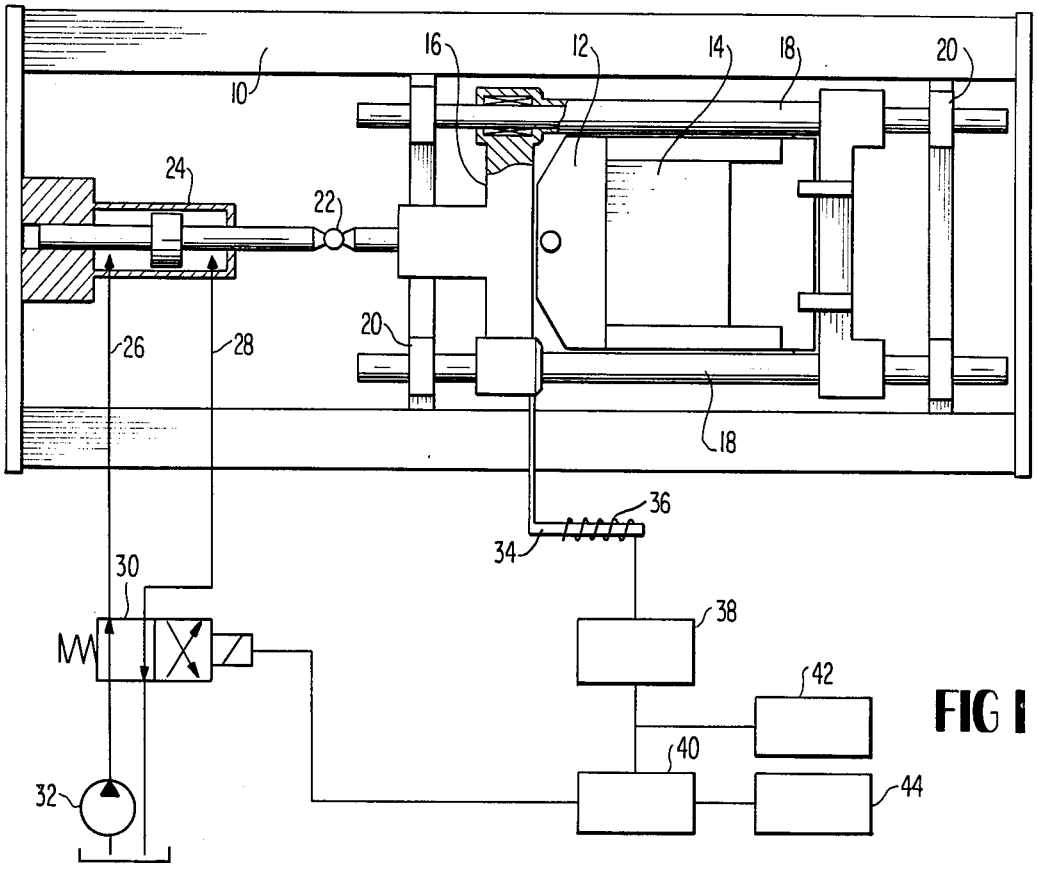
FIG. 1 is a schematic diagram of one form of drive for the reciprocating slurry saw of this invention.

In the FIG. 1 embodiment, a slurry saw machine base 10 carries a removable blade clamping frame 12 within which a plurality of blades 14 are spaced apart and tensioned. The removable blade carrier 12 is carried in a reciprocatable frame 16 which reciprocates on parallel guides 18 fixed by supports 20 to the frame 10.

Drive of the frame 16 is through linkage 22 from a double-acting hydraulic cylinder 24. The cylinder is fed by hydraulic fluid from opposite sides through lines 26 and 28 under the control of servo valve 30 using fluid from hydraulic pump 32.

The frame 16 has an extension 34 which moves therewith relative to a coil 36 so that the assembly functions as a displacement transmitter. The displacement of the frame as transmitted is sensed by test amplifier 38 which feeds into servo amplifier 40. An oscillograph 42 is connected as shown, and a desired value transmitter 44 may be used to control the servo amplifier 40.

With this type of drive, very high frequencies, up to at least 100 cycles per second, can be obtained. An important advantage is that the frequency can be selected by a simple adjustment of the frequency of the cycle determiner according to demand. At the same time, the stroke can be adjusted with practically infinite variability by adjusting the supplied hydraulic fluid quantity in a simple manner (see, e.g., FIG. 2). For testing and monitoring purposes, the displacement of the frame, through the displacement transmitter, can be displayed and, if desired, regulation for the stroke can be accomplished. Large forces can be employed. This type of drive combines many advantages. Not only may the frequency be as great as 100 cycles per second but the stroke can be in the range of 10–50 millimeters, much less than the stroke of conventional and known slurry saws.

Figure 2:
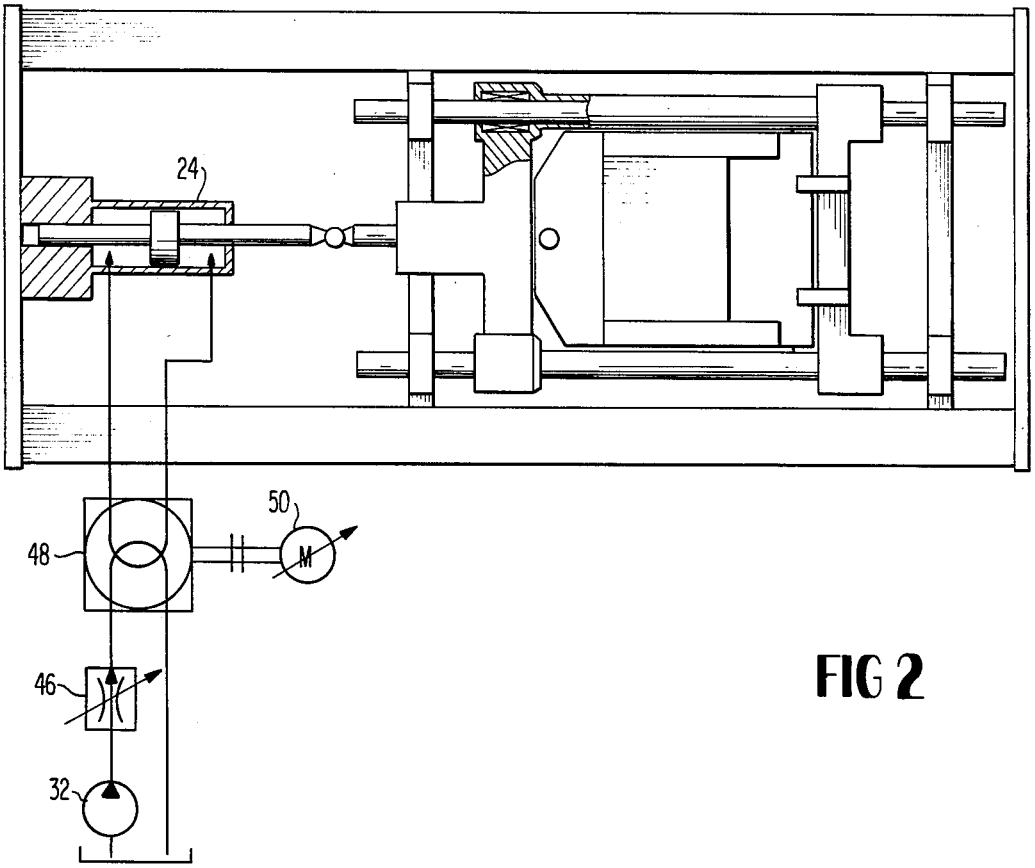
FIG. 2 is a schematic view of another form of drive.

A variation of the hydro-impulse drive is shown in FIG. 2. The same elements of the clamping frame are as in FIG. 1, and there is also the same drive cylinder and fluid lines. In FIG. 2, however, the hydraulic pump 32 feeds through a fluid flow control unit 46 for the purpose of amplitude control and feeds into a fluid pulse generator 48 which, in turn, is controlled by a control motor 50 which provides the frequency control.

Figure 3:
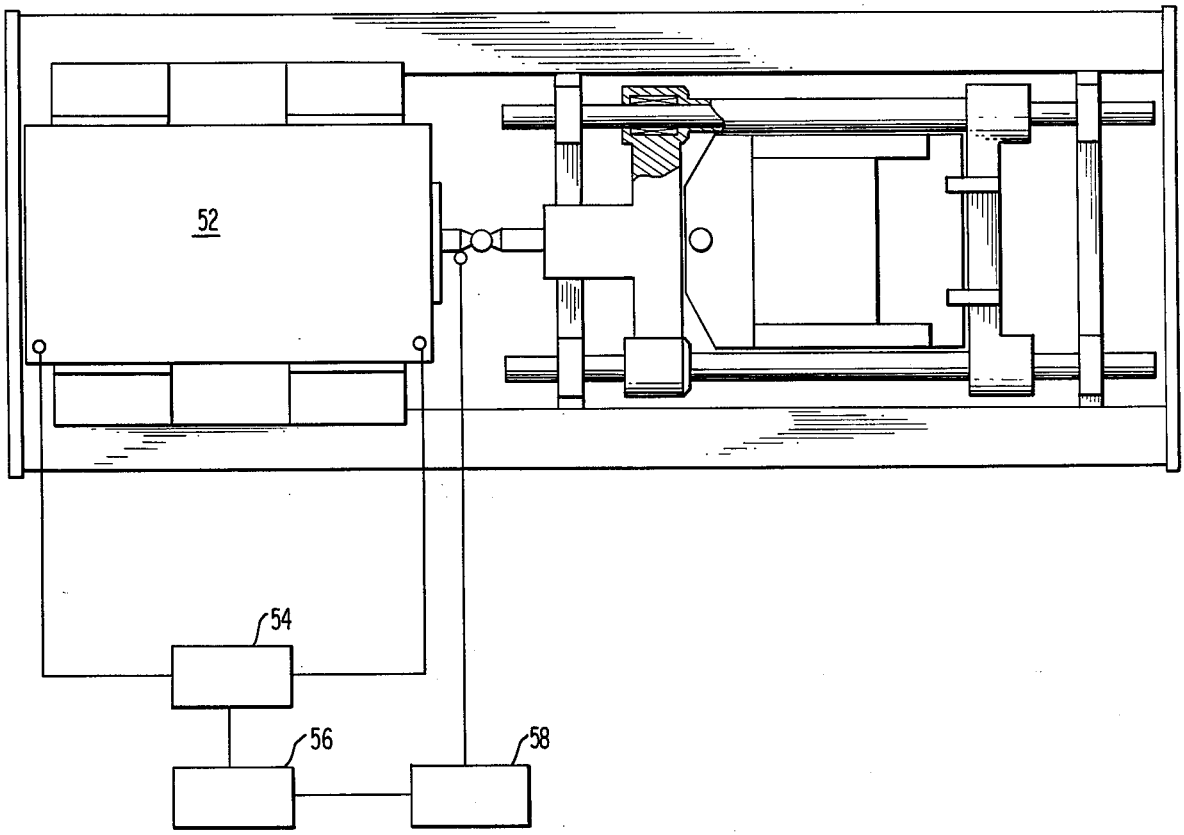
FIG. 3 is a schematic view of another form of drive.

FIG. 3 shows another embodiment using an electromagnetic or electrodynamic drive for the clamping frame, which clamping frame is the same as in FIG. 1. The drive in this case is a vibration exciter 52 connected to a power amplifier 54 which, in turn, derives from a sine wave generator 56 connected through a conditioning amplifier 58. A small stroke in the range of just a few centimeters, for example, five centimeters, can be utilized, and the frequency can be 50 or 100 cycles per second. An embodiment with soft iron armatures, such as plunger-type armatures, is distinguished by extraordinary simplicity and is suitable as a drive for light clamping frames with a short stroke but high frequency.

Figure 4:
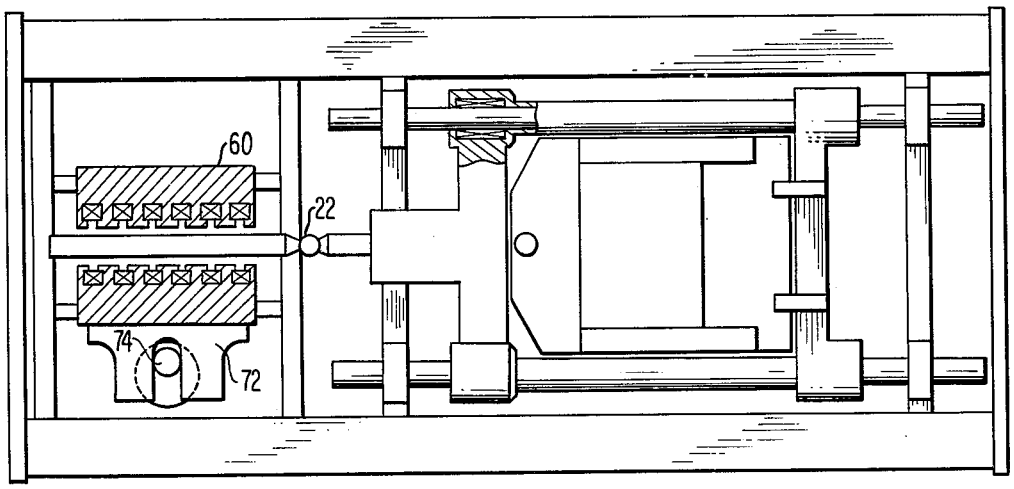
FIG. 4 is a schematic view of another form of drive.

FIG. 4 shows the same clamping frame but with another embodiment utilizing an electrical linear motor 60 as the reciprocating drive coupled in a suitable manner by conventional coupling means 22 to drive the clamping frame 16.

Figure 5:
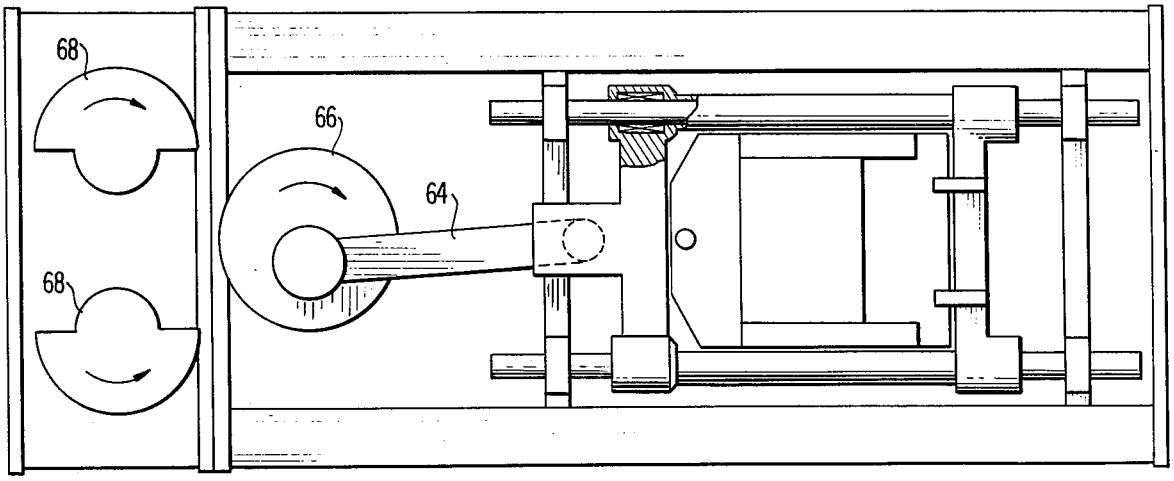
FIG. 5 is a schematic view of another form of drive.

A crank drive is shown in FIG. 5 in which the drive is through a connecting rod 64 from a rotating crank 66. A pair of flywheel mass compensators 68 are utilized to damp the vibration.

Figure 6:
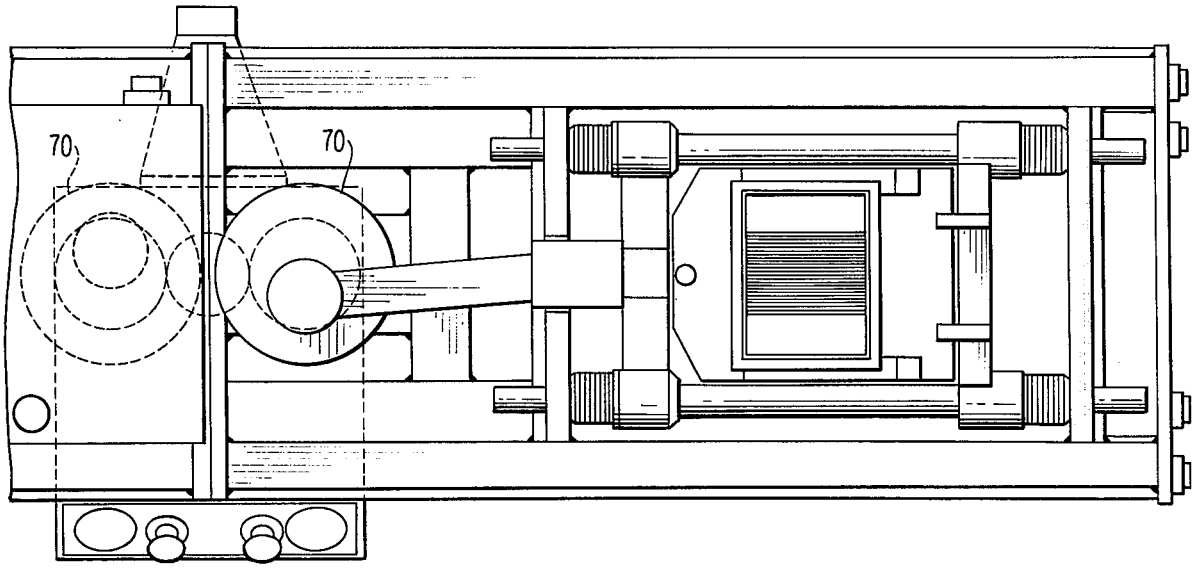
FIG. 6 is a schematic view of another form of drive.

FIG. 6 shows a further embodiment in which there is a twin machine driven by a pair of eccentrics or cranks 70 which are 180° out of phase. This guarantees mass balance.

In all embodiments, the work-piece is mounted underneath the blades, and has a vertical feed as is well known per se.

Also as shown in FIG. 4, it is also possible to overlap a rapidly oscillating motion with a slow movement such as produced by conventional drives. This is accomplished by mounting the linear motor 60 which produces rapid oscillations on the frame 72 driven by an eccentric 74. Thus, the relative speed between the cutting blades and the work-pieces vary high during low amplitudes of the oscillating motion, and the cutting blades are subject to equal demands along their entire length. The slow movement involved can be a uniform movement in one direction or, preferably, a slow uniform reciprocating movement. A known cam drive with connecting rods can also be provided.

I claim:

1. A method for increasing the cutting performance of a reciprocating slurry saw of the type including a plurality of spaced blades held in a clamping frame, which frame is reciprocated with respect to a work-piece in order to allow the blades, with the aid of an abrasive slurry, to cut the work-piece, the improvement comprising: displacing the reciprocating clamping frame and blades transversely to a work-piece in a single oscillatory mode at a frequency between 3 and 100 cycles per second, utilizing a short stroke between 10 and 75 millimeters.

2. A method as in claim 1 wherein the average cutting speed exceeds 30 meters per minute.

3. In a reciprocating slurry saw apparatus of the type including base, a reciprocating clamping head holding in tension a plurality of spaced parallel blades, means for supporting a work-piece adjacent to blades to be cut, means for feeding an abrasive slurry over a cutting area where the blades contact the work-piece, and means for driving the clamping head in a reciprocatory motion, the improvements comprising: means operating the driving means to cause the clamping head to reciprocate transversely to a work-piece in a single oscillatory mode at a frequency between 3 and 100 cycles per second, utilizing a short stroke between 10 and 75 millimeters.

4. An apparatus as in claim 3 wherein the last recited means is a double-acting hydraulic cylinder and a reversing servo valve controlled by a cycle determiner.

5. An apparatus as in claim 3 wherein a stroke determining means is provided for determining and indicating the stroke of the clamping frame.

6. An apparatus as in claim 4 further comprising a regulating valve which is controlled by the stroke determining means to regulate the stroke of the clamping frame.

7. An apparatus as in claim 3 wherein the last recited means is an electrodynamic vibrator means.

8. An apparatus as in claim 3 wherein the last recited means is an electric linear motor.

9. An apparatus as in claim 3 wherein the last recited means is an eccentric crank drive with mass balancing means.

* * * * *